US007163051B2

(12) United States Patent
Jibb

(10) Patent No.: US 7,163,051 B2
(45) Date of Patent: Jan. 16, 2007

(54) HEAT EXCHANGER DISTRIBUTOR FOR MULTICOMPONENT HEAT EXCHANGE FLUID

(75) Inventor: Richard J. Jibb, Amherst, NY (US)

(73) Assignee: Praxair Technology, Inc., Danbury, CT (US)

( * ) Notice: Subject to any disclaimer, the term of this patent is extended or adjusted under 35 U.S.C. 154(b) by 249 days.

(21) Appl. No.: 10/649,674

(22) Filed: Aug. 28, 2003

(65) Prior Publication Data

US 2005/0045312 A1 Mar. 3, 2005

(51) Int. Cl.
*F28D 1/03* (2006.01)

(52) U.S. Cl. ..... 165/110; 165/166; 261/156

(58) Field of Classification Search ..... 165/110, 165/116; 62/903; 261/156
See application file for complete search history.

(56) References Cited

U.S. PATENT DOCUMENTS 3,256,704 A * 6/1966 Becker ..... 165/166
3,282,334 A * 11/1966 Stahlheber ..... 165/166
3,310,105 A * 3/1967 Butt ..... 165/166
3,559,722 A * 2/1971 Schauls et al. ..... 165/166
3,568,462 A * 3/1971 Hoffman et al. ..... 165/166
3,612,494 A * 10/1971 Toyama et al. ..... 261/102
3,792,842 A * 2/1974 Nakako et al. ..... 261/148
4,249,595 A * 2/1981 Butt ..... 165/110
4,646,822 A 3/1987 Voggenreiter et al. ..... 165/166
4,715,433 A * 12/1987 Schwarz et al. ..... 165/110
RE33,026 E * 8/1989 Petit et al. ..... 165/166
5,122,174 A * 6/1992 Sunder et al. ..... 62/654
5,438,836 A 8/1995 Srinivisan et al. ..... 62/36
5,537,840 A 7/1996 Srinivasan et al. ..... 62/643
5,709,264 A * 1/1998 Sweeney et al. ..... 165/115
5,722,258 A * 3/1998 Aitken ..... 62/643
5,724,834 A 3/1998 Srinivasan et al. ..... 62/643
5,755,279 A * 5/1998 Sweeney et al. ..... 165/115
6,044,902 A 4/2000 Pahade et al. ..... 165/166
6,065,305 A 5/2000 Arman et al. ..... 62/613
6,330,811 B1 12/2001 Arman et al. ..... 62/643
2004/0069471 A1* 4/2004 Corduan et al. ..... 165/165

* cited by examiner

*Primary Examiner*—Teresa J. Walberg
(74) *Attorney, Agent, or Firm*—David M. Rosenblum

(57) ABSTRACT

A heat exchanger distributor which facilitates homogeneous flow of a two phase multicomponent heat exchange fluid, such as a refrigerant fluid, comprising a plurality of spaced dividers, extending longitudinally through some or all of the length of the finned section of the distributor, which prevent lateral movement and agglomerization of gas bubbles and a lower threshold for flow reversal and liquid logging.

8 Claims, 2 Drawing Sheets

HEAT EXCHANGER DISTRIBUTOR FOR MULTICOMPONENT HEAT EXCHANGE FLUID

TECHNICAL FIELD

This invention relates to heat exchange using multicomponent heat exchange fluid such as multicomponent refrigerant fluid.

BACKGROUND ART

In the practice of heat exchange wherein the heat exchange fluid comprises both a vapor phase and a liquid phase, it is important for the attainment of efficient heat exchange that the vapor and liquid phases of the heat exchange fluid flow through the heat exchanger with a substantially homogeneous flow. The issue of homogeneous flow and the problems resulting from substantial deviation from homogeneous flow are particularly important when the heat exchange fluid is a multicomponent heat exchange fluid, such as a multicomponent refrigerant fluid, which comprises two or more components having different boiling points. In such cases the two phase mixture is separated into a vapor phase and a liquid phase which are introduced separately and mixed in the heat exchanger.

One phenomenon which results in deviations from homogeneous flow in a heat exchanger is flow reversal. If the vapor mass fraction of the heat exchange fluid is very low, the vapor velocity may be low and liquid may drain into the vapor inlet header and become trapped thereby removing this material from circulation in the heat exchange circuit. This problem of flow reversal may be addressed by increasing the local vapor velocity, but this solution increases the cost and reduces the efficiency of the heat exchange.

Another phenomenon which results in deviations from homogeneous flow in a heat exchanger is liquid logging. If the vapor mass fraction is very low, the liquid and vapor phases have a tendency to separate so as to provide the vapor with a path of least resistance through the heat exchanger. This results in the liquid phase becoming trapped within the heat exchanger and markedly reduces the efficiency of the heat exchange.

Accordingly it is an object of this invention to provide a heat exchanger distributor for a multicomponent heat exchange fluid which prevents flow reversal and liquid logging thereby ensuring substantially homogeneous flow of vapor and liquid phases of the heat exchange fluid even when the local fluid velocity and the vapor mass fraction of the heat exchange fluid are relatively small.

SUMMARY OF THE INVENTION

The above and other objects, which will become apparent to those skilled in the art upon a reading of this disclosure, are attained by the present invention which is:

A heat exchanger distributor for multicomponent heat exchange fluid comprising:

(A) a main volume comprising a hardway fin section and a main fin section;

(B) means for providing multicomponent heat exchange fluid to the main volume, and means for withdrawing multicomponent heat exchange fluid from the main volume; and (C) a plurality of spaced dividers longitudinally oriented within the main volume, each of said dividers traversing substantially the entire hardway fin section.

As used herein the term "hardway fin" means a structure wherein the fins or corrugations are oriented perpendicular to the fluid flow thereby providing maximum resistance to the fluid flow.

DETAILED DESCRIPTION

In general, the invention enables stable homogeneous flow of heat exchange fluid, even when the vapor mass fraction and the total mass velocity of the heat exchange fluid is low, by preventing lateral movement of vapor bubbles.

Figure 1:
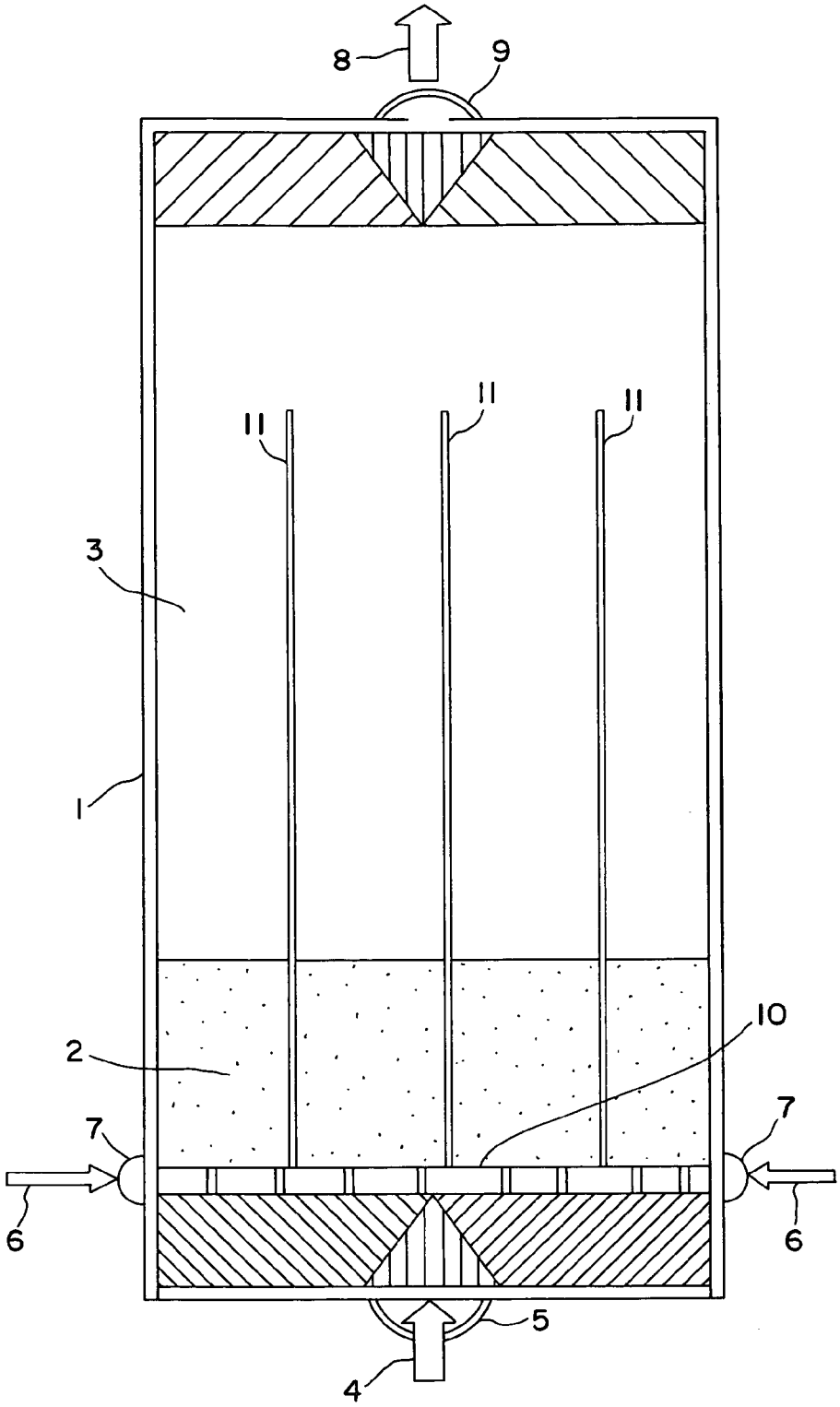
FIG. 1 is a cross sectional representation of one preferred embodiment of the invention.

The invention will be discussed in detail with reference to the Drawings. Referring now to FIG. 1, heat exchanger distributor 1 comprises a main volume having a hardway fin section 2 which comprises hardway fins, and a main fin section 3 which comprises main fins such as serrated or perforated fins. Hardway fin section 2 may comprise one or two or more subsections of different hardway fine, and main fin section 3 may comprise one or two or more subsections of different main fins. The main fin section, having fins which are oriented in line with the fluid flow, may comprise from 66 to 99 percent of the main volume. Vapor is provided to distributor 1, as shown by flow arrow 4, through vapor inlet 5, and liquid is provided to distributor 1, as shown by flow arrow 6, through liquid inlet 7 to distributor bar 10. Homogeneous mixed phase heat exchange fluid is withdrawn from distributor 1, as shown by flow arrow 8, through outlet 9. Preferably, as shown in FIG. 1, distributor 1 is vertically oriented such that the heat exchange fluid flows upwardly through the main volume.

A plurality of spaced dividers 11 are longitudinally oriented within the main volume. Each of these dividers traverses substantially the entire length of the hardway fin section. In the embodiment of the invention illustrated in FIG. 1 each of the spaced dividers additionally traverses at least a portion of the main fin section. The dividers may extend the entire length of the main volume. The dividers are placed with a gap preferably not larger than 0.0625 inch from the distributor bar and are placed at least 3 inches apart. The width of the dividers is preferably about 0.125 inch. Preferably the entire assembly is brazed in a furnace.

The operation of the invention with respect to the embodiment illustrated in the Figures will now be described.

Prior to entering distributor 1 the two phase multicomponent fluid is separated into a vapor phase and a liquid phase. The liquid phase is fed to the inlet header tank 7 wherein it is divided evenly between the layers of the heat exchanger. On entering a single layer the liquid phase flows into the liquid side of distributor bar 10. The liquid side of the distributor bar 10 is sealed against the vapor side from below, so it is impossible for liquid to drain into the vapor header tank via this route. Liquid is distributed within each layer by means of openings in the top of the liquid side of the distributor bar. Dividers 11 define a number of heat transfer subsections in the main volume in which the liquid flow is evenly distributed and mixed with the vapor phase to form a homogeneous two phase mixture.

Figure 2:
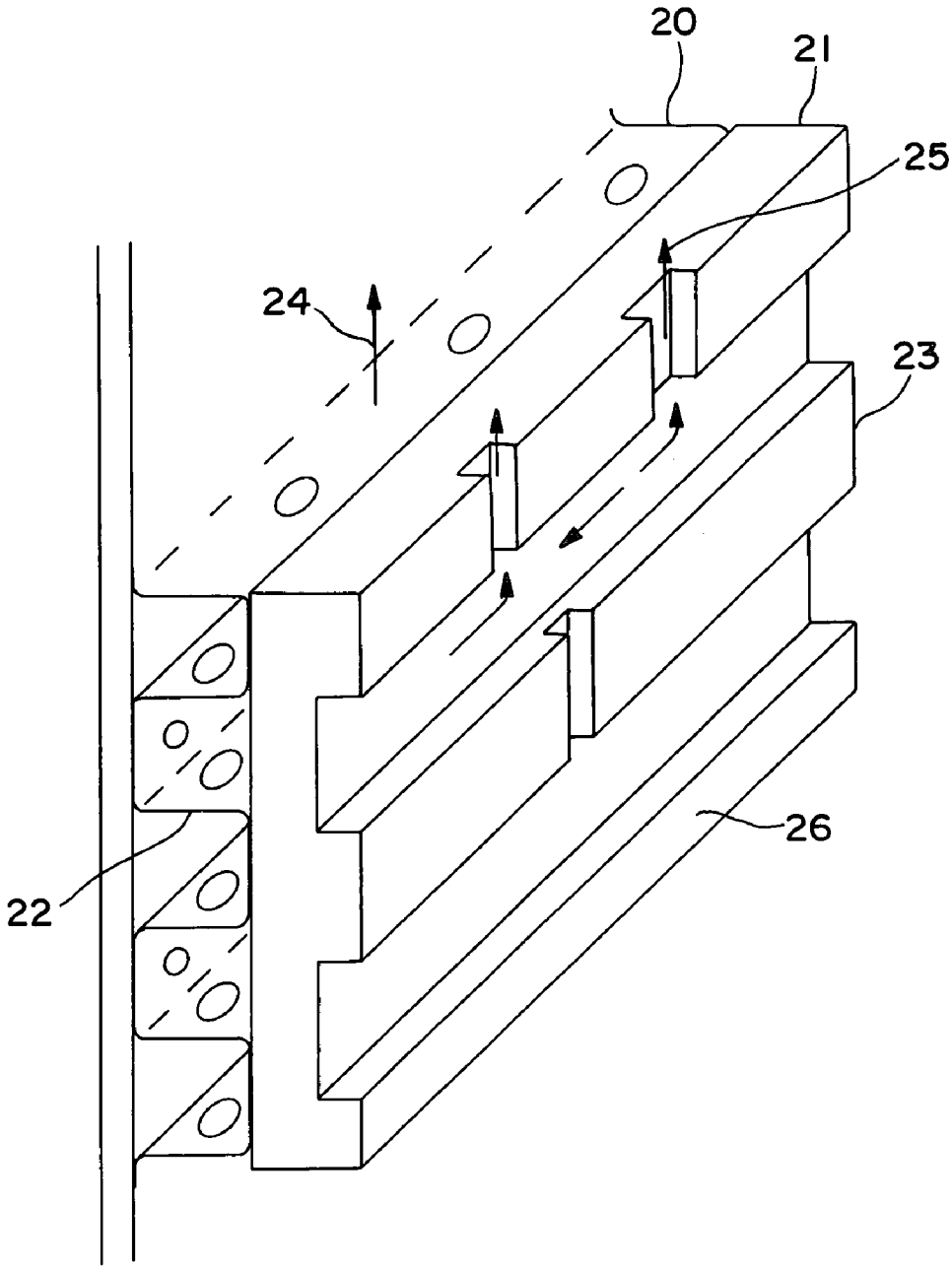
FIG. 2 is a representation of one particularly preferred embodiment of a hardway/slotted bar distributor design for use in the practice of the invention.

The vapor phase is fed to the vapor inlet header tank 5 and directed to distributor bar 10 via a section of plain fins. The local vapor velocity in the vapor side of distributor bar 10 is substantially higher than in the main volume so as to prevent liquid from draining back into the vapor inlet header. One method of achieving this is to use narrow slots on the vapor side of the distributor bar. Another method is to use a section of hardway fins with a fin height of about 0.2 inch, which is roughly half the height of a layer (0.375 inch). One arrangement for effecting this latter method is illustrated in FIG. 2 wherein the vapor side 20 and liquid side 21 employ hardway fins 22 and a slotted bar 23 for the flow of vapor 24 and liquid 25 respectively. Seal 26 is used to prevent liquid drainage.

The vapor phase is fed evenly to each of the heat transfer subsections wherein it is mixed with the liquid phase. The two phase mixture leaving distributor bar 10 is heated and vaporized in the main volume. In the initial part of the main volume, the average velocity is low which limits the rate of heat transfer. For this reason hardway fins are employed to greatly increase the heat transfer rate. As more vapor is generated further up the main volume, the pressure loss increases to an unacceptable level. Hence conventional fins, such as serrated or perforated fins are employed in place of hardway fins. The two phase mixture is partially or completely vaporized in the main volume and leaves the heat exchanger via a section of plain fins which direct the flow to the outlet header tank 9.

In the invention the dividers serve to prevent lateral movement and agglomerization of gas bubbles. By the prevention of this lateral movement and agglomerization, the vapor and liquid phases of the heat exchange fluid are prevented from separating. In this way, a homogeneous vapor liquid upflow is maintained, even when the total mass velocity is low.

Although the invention has been described in detail with reference to a certain preferred embodiment, those skilled in the art will recognize that there are other embodiments of the invention within the spirit and the scope of the claims.

The invention claimed is:

1. A heat exchanger distributor for multicomponent heat exchange fluid comprising:

(A) a main volume comprising a hardway fin section and a main fin section;

(B) a distributor bar communicating with the hardway fin section of the main volume, means for providing a liquid phase of a multicomponent heat exchange fluid to the distributor bar, means for providing a vapor phase of the multicomponent heat exchange fluid to the distributor bar, and means for withdrawing multicomponent heat exchange fluid from the main volume; and (C) a plurality of spaced dividers longitudinally oriented within the main volume, each of said dividers traversing substantially the entire hardway fin section.

2. The distributor of claim 1 wherein the main fin section comprises from 66 to 99 percent of the main volume.

3. The distributor of claim 1 wherein the dividers additionally traverse at least a portion of the main fin section.

4. The distributor of claim 1 wherein the dividers are spaced at least 3 inches apart.

5. The distributor of claim 1 wherein the hardway fin section comprises two or more subsections of different hardway fins.

6. The distributor of claim 1 wherein the main fin section comprises two or more subsections of different main fins.

7. The distributor of claim 1 wherein the distributor bar comprises adjacent slotted bars and hardway fins for the flow therethrough of liquid and vapor respectively.

8. The distributor of claim 1 wherein the dividers are placed with a gap from the distributor bar.

* * * * *